US011454116B2

(12) United States Patent
Nakamura

(10) Patent No.: US 11,454,116 B2
(45) Date of Patent: Sep. 27, 2022

(54) SCROLL EXPANDER WITH EXHAUST PATH THRU BEARINGS AND A PARTITION PLATE

(71) Applicant: SANDEN AUTOMOTIVE COMPONENTS CORPORATION, Isesaki (JP)

(72) Inventor: Shinji Nakamura, Isesaki (JP)

(73) Assignee: SANDEN AUTOMOTIVE COMPONENTS CORPORATION, Isesaki (JP)

( * ) Notice: Subject to any disclaimer, the term of this patent is extended or adjusted under 35 U.S.C. 154(b) by 0 days.

(21) Appl. No.: 17/055,968

(22) PCT Filed: May 17, 2019

(86) PCT No.: PCT/JP2019/019751
§ 371 (c)(1),
(2) Date: Nov. 16, 2020

(87) PCT Pub. No.: WO2019/235185
PCT Pub. Date: Dec. 12, 2019

(65) Prior Publication Data

US 2021/0254466 A1 Aug. 19, 2021

(30) Foreign Application Priority Data

Jun. 8, 2018 (JP) ..... JP2018-110528

(51) Int. Cl.
*F01C 1/02* (2006.01)
*F01C 19/12* (2006.01)
*F01C 21/10* (2006.01)

(52) U.S. Cl.
CPC ..... *F01C 1/0215* (2013.01); *F01C 19/125* (2013.01); *F01C 21/10* (2013.01)

(58) Field of Classification Search
CPC ..... F01C 19/125; F01C 1/0215; F01C 21/10
See application file for complete search history.

(56) References Cited

U.S. PATENT DOCUMENTS

2006/0107681 A1 5/2006 Uno et al.
2012/0031141 A1* 2/2012 Wada ..... F01C 1/0215 62/529

(Continued)

FOREIGN PATENT DOCUMENTS

CN 103069114 A 4/2013
CN 104271951 A 1/2015

(Continued)

OTHER PUBLICATIONS

Japan Patent Office, International Search Report issued in International Application No. PCT/JP2019/019751, dated Jul. 9, 2019.

(Continued)

*Primary Examiner* — Mary Davis
(74) *Attorney, Agent, or Firm* — Baker Botts L.L.P.

(57) ABSTRACT

A housing of a scroll type expansion machine includes: a suction port formed at a position on the opposite side to a drive shaft with a fixed scroll interposed therebetween; a discharge port formed on the side of a drive-side bearing closer to the tip end of the drive shaft; a low pressure chamber formed on the outer side of an orbiting-side scroll portion when viewed from the axial direction of the drive shaft; and a tip end-side low-pressure space being a space in which a sealing member is disposed, and has: a partition wall partitioning the tip end-side low-pressure space and the low-pressure chamber from each other; and a communication space communicating the tip end-side low-pressure space with the low-pressure chamber.

7 Claims, 5 Drawing Sheets

(56) References Cited

U.S. PATENT DOCUMENTS

| | | | | |
|---|---|---|---|---|
| 2013/0134720 | A1* | 5/2013 | Fukasaku ..... | F01C 1/0215 290/40 R |
| 2015/0098845 | A1 | 4/2015 | Nakamura | |

FOREIGN PATENT DOCUMENTS

| | | | |
|---|---|---|---|
| JP | 58-222901 | A | 12/1983 |
| JP | 2003-161101 | A | 6/2003 |
| JP | 2006-057568 | A | 3/2006 |
| JP | 2006-233909 | A | 9/2006 |
| JP | 2013-234585 | A | 11/2013 |

OTHER PUBLICATIONS

The State Intellectual Property Office of the People's Republic of China, The First Office Action issued in Chinese Application No. CN 201980032619.1,dated Nov. 9, 2021.

Japan Patent Office, Japanese Office Action issued in Japanese Application No. JP 2018-110528, dated Feb. 8, 2022.

* cited by examiner

SCROLL EXPANDER WITH EXHAUST PATH THRU BEARINGS AND A PARTITION PLATE

CROSS-REFERENCE TO RELATED APPLICATIONS

This application is a U.S. National Stage patent application under 35 U.S.C. § 371 of International Patent Application No. PCT/JP2019/019751, filed on May 17, 2019, which claims the benefit of Japanese Patent Application No. 2018-110528, filed on Jun. 8, 2018, the disclosures of each of which are incorporated herein by reference in their entirety.

TECHNICAL FIELD

The present invention relates to a scroll type expander included in, for example, a power generation apparatus using a Rankine cycle.

BACKGROUND ART

Examples of a scroll type expander included in a power generation apparatus using a Rankine cycle include a scroll type expander described in PTL 1.

In the scroll type expander described in PTL 1, an expander body includes a cylindrical first housing one end of which in the axial direction is opened and a second housing that closes the opening portion of the first housing. An inlet for a working fluid (refrigerant) is formed on the other end surface of the first housing, and an outlet for the refrigerant is formed on the side surface of the first housing.

CITATION LIST

Patent Literature

PTL 1: JP 2006-57568 A

SUMMARY OF INVENTION

Technical Problem

In the scroll type expander described in PTL 1, the inlet for the refrigerant is formed on the other end surface of the first housing, and the outlet for the refrigerant is formed on the side surface of the first housing. Further, inside the second housing, a sealing member that surrounds the outer peripheral surface of an output shaft is arranged at a position further apart from the first housing than the outlet for the refrigerant. Thus, a large portion of the refrigerant, which is introduced from the inlet and discharged from the outlet, does not move to the position further apart from the first housing than the outlet, and the amount of refrigerant flowing around the sealing member is small. There is a problem in that, because of this phenomenon, when temperature of the expander body increases and the sealing member is heated, it is difficult to cool the sealing member by use of the refrigerant and sealing performance of the sealing member deteriorates. This problem is particularly prominent when ethanol is used as a refrigerant.

The present invention has been made in view of the problem as described above, and an object of the present invention is to provide a scroll type expander that is capable of preventing sealing performance of a sealing member from deteriorating.

Solution to Problem

In order to solve the above-described problem, one aspect of the present invention is a scroll type expander that includes a housing, a drive shaft, a fixed scroll, an orbiting scroll, a bearing, and a sealing member and is used in a Rankine cycle in which a working fluid circulates. The drive shaft has a base end housed in the housing and a tip end projecting out of the housing. The fixed scroll is fixed to the side closer to the base end of the drive shaft rather than to the tip end of the drive shaft inside the housing. The fixed scroll has a fixed-side scroll portion formed in a spiral shape when viewed from the axial direction of the drive shaft. The orbiting scroll has an orbiting-side scroll portion that is formed in a spiral shape when viewed from the axial direction of the drive shaft and meshes with the fixed-side scroll portion. The orbiting scroll is arranged on the side of the fixed scroll closer to the tip end of the drive shaft in a rotatable structure inside the housing. The bearing is arranged on the side of the orbiting scroll closer to the tip end of the drive shaft inside the housing and configured to support the drive shaft in a rotatable structure with respect to the housing via a plurality of rolling elements. The sealing member is arranged on the side of the bearing closer to the tip end of the drive shaft inside the housing and configured to surround the outer peripheral surface of the drive shaft. The housing includes a suction port, a discharge port, a low-pressure chamber, and a tip end-side low-pressure space. The suction port is formed at a position on the opposite side to the drive shaft with the fixed scroll interposed therebetween and configured to introduce high-pressure working fluid from an external circuit. The discharge port is formed on the side of the bearing closer to the tip end of the drive shaft and configured to discharge low-pressure working fluid to an external circuit. The low-pressure chamber is a chamber that is formed on the outer side of the orbiting-side scroll portion when viewed from the axial direction of the drive shaft. The tip end-side low-pressure space is a space in which the sealing member is arranged. A partition wall that partitions the tip end-side low-pressure space and the low pressure chamber from each other is disposed at a position that is located between the tip end-side low-pressure space and the low pressure chamber when viewed from a radial direction of the drive shaft and located closer to the discharge port than the drive shaft when viewed from the axial direction of the drive shaft. Further, a communication space that communicates the tip end-side low-pressure space and the low pressure chamber with each other is disposed at a position that is located between the tip end-side low-pressure space and the low pressure chamber when viewed from a radial direction of the drive shaft and opposed to the discharge port with the center of the drive shaft interposed therebetween when viewed from the axial direction of the drive shaft.

Advantageous Effects of Invention

According to the one aspect of the present invention, high-pressure working fluid that is introduced from the suction port expands in the expansion chamber, which is formed between the fixed-side scroll portion and the orbiting-side scroll portion, becomes low-pressure working fluid the temperature of which has decreased, and moves to the low-pressure chamber. The low-pressure working fluid that has been prevented from moving from the low-pressure chamber to the tip end-side low-pressure space by the partition wall, passing the communication space and interspaces between adjacent rolling elements, moves from the low-pressure chamber to the tip end-side low-pressure space.

Because of this capability, it becomes possible to increase the flow rate of the low-pressure working fluid, the temperature of which has decreased from a state when the working fluid was introduced into the housing, that passes the vicinity of the drive shaft and the sealing member and to thereby actively cool the sealing member. Thus, it becomes possible to provide the scroll type expander that is capable of suppressing heating of the sealing member and preventing sealing performance of the sealing member from deteriorating.

DESCRIPTION OF EMBODIMENTS

A first embodiment of the present invention will now be described with reference to the drawings. In the illustration of the drawings referred to in the following description, the same or similar signs are assigned to the same or similar constituent components. However, it should be noted that the drawings are schematic, where a relation between thickness and planar dimensions, thickness ratios between respective layers, and the like are different from actual ones. Therefore, specific thickness and dimensions should be determined in consideration of the following description. It should also be noted that portions having differences in dimensional relationships and ratios among the drawings are included.

Further, the following first embodiment indicates a configuration to embody the technical idea of the present invention by way of example, and the technical idea of the present invention does not limit the materials, shapes, structures, arrangements, and the like of the constituent components to those described below. The technical idea of the present invention can be subjected to a variety of alterations within the technical scope prescribed by the claims described in CLAIMS. In addition, the directions of "right and left" and "up and down" in the following description are merely definitions for convenience of description, and do not limit the technical idea of the present invention. Thus, it is needless to say that, for example, when the plane of paper is rotated 90 degrees, the "right and left" and the "up and down" are interpreted in an interchanging manner, and, when the plane of paper is rotated 180 degrees, the "left" becomes the "right" and the "right" becomes the "left".

First Embodiment

Hereinafter, a first embodiment of the present invention will be described with reference to the drawings.

(Configuration)

Using FIGS. 1 to 4, a configuration of the first embodiment will be described.

(Scroll Type Expander)

Figure 1:
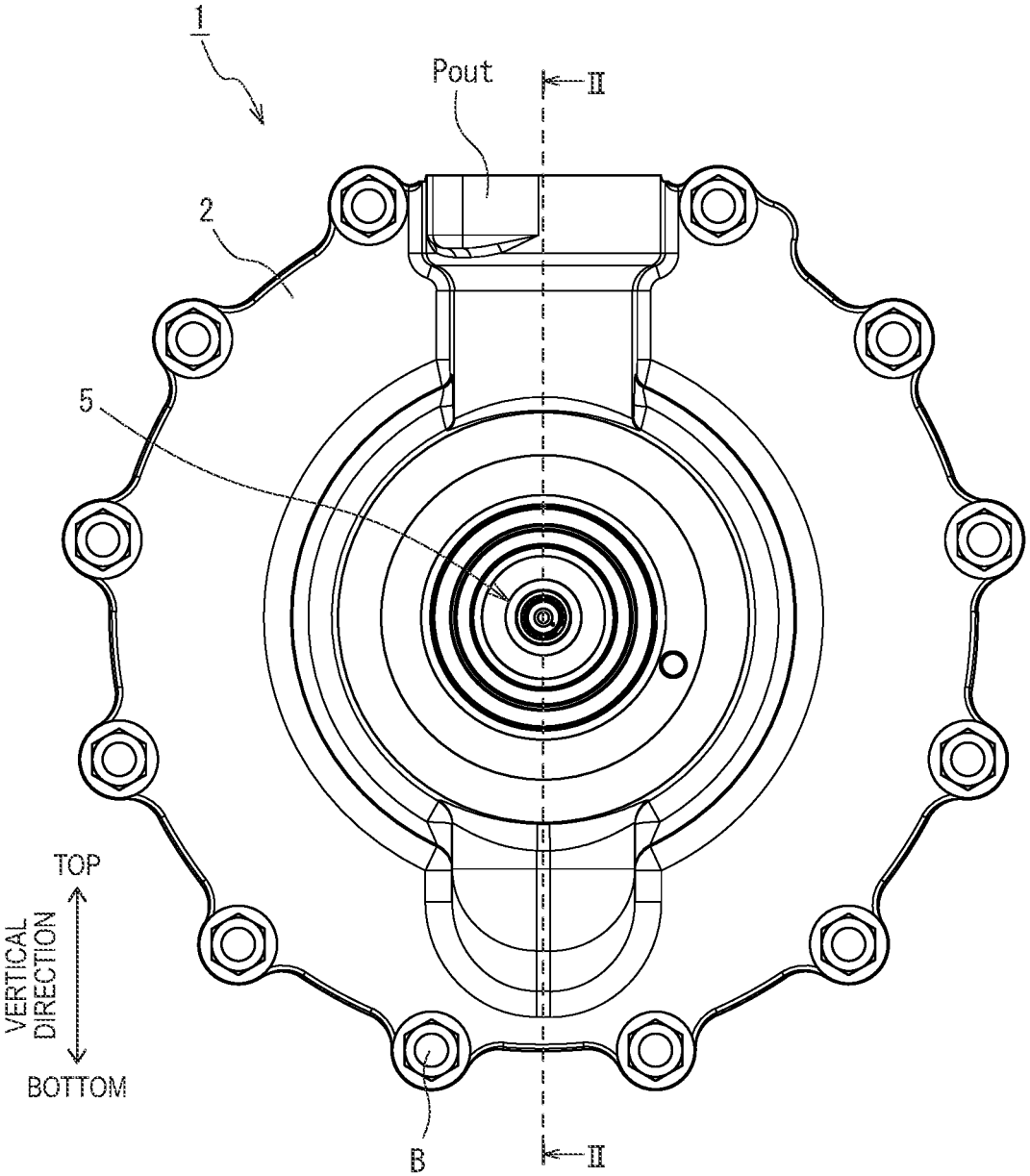
FIG. 1 is a diagram illustrative of a configuration of a scroll type expander in a first embodiment of the present invention.
Figure 2:
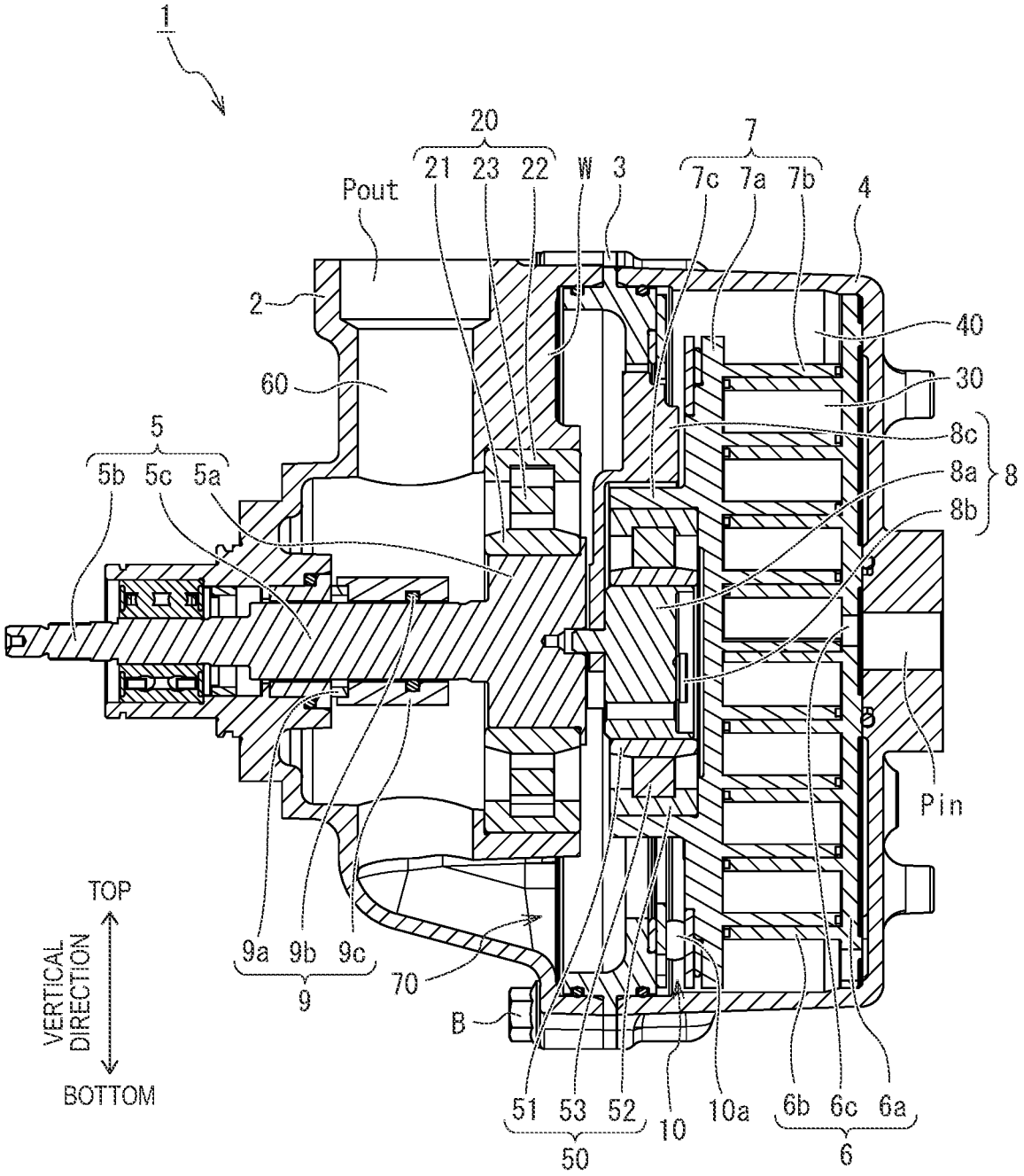
FIG. 2 is a cross-sectional view taken along the line II-II in FIG. 1.

As illustrated in FIGS. 1 and 2, a scroll type expander 1 includes a front housing 2, a center plate 3, a rear housing 4, a drive shaft 5, and a fixed scroll 6. In addition to the above, the scroll type expander 1 includes an orbiting scroll 7, a driven crank mechanism 8, a sealing member 9, a rotation preventing mechanism 10, and a partition wall W.

The scroll type expander 1 is used in a Rankine cycle in which a working fluid (refrigerant) circulates.

In the first embodiment, a case where ethanol is used as the refrigerant will be described as an example. Note that, as the refrigerant, a substance other than ethanol can be used.

The Rankine cycle will be described below.

The Rankine cycle recovers exhaust heat generated by an engine, which serves as an external heat source, (for example, heat of engine cooling water), converts the heat to power, and outputs the power. In a circulation path for a working fluid that the Rankine cycle has, for example, a heater, the scroll type expander 1, a condenser, and a pump are arranged.

The heater is a heat exchanger that causes heat exchange to be performed between engine cooling water having absorbed heat from the engine and the working fluid circulating in the Rankine cycle and thereby heats the working fluid into superheated steam.

The scroll type expander 1 expands and converts the working fluid, which has been heated in the heater into superheated steam, to rotational energy and thereby generates power (driving force).

The condenser is a heat exchanger that causes heat exchange to be performed between the working fluid having gone through the scroll type expander 1 and the outside air and thereby cools and condenses (liquefies) the working fluid.

(Front Housing, Center Plate, and Rear Housing)

The front housing 2 and the rear housing 4 forma housing of the scroll type expander 1 by being fastened to each other by through bolts B with the center plate 3 interposed therebetween.

Oil for lubrication (not illustrated) is enclosed inside the housing, and, when the working fluid moves inside the scroll type expander 1, the oil moves in conjunction with the working fluid and the inside of the scroll type expander 1 is lubricated.

(Drive Shaft)

The drive shaft 5 includes a large-diameter portion 5*a*, a small-diameter portion 5*b*, and an intermediate portion 5*c*.

The large-diameter portion 5*a* constitutes a base end of the drive shaft 5 and is housed in the front housing 2 (housing).

Between the large-diameter portion 5*a* and the front housing 2, a drive-side bearing 20 (bearing) is arranged. Details of the drive-side bearing 20 will be described later.

The small-diameter portion 5*b* constitutes a tip end of the drive shaft 5 and has a smaller outer diameter than the large-diameter portion 5*a*.

The tip end side of the small-diameter portion 5*b* projects to the outside of the front housing 2.

The intermediate portion 5*c* is formed between the large-diameter portion 5*a* and the small-diameter portion 5*b* and has an outer diameter smaller than the large-diameter portion 5*a*. The outer diameter is larger than the small-diameter portion 5*b*.

With the above-described configuration, the drive shaft 5 is arranged inside the front housing 2 (housing) and has both ends supported by the front housing 2 in a rotatable structure.

At a position on the side of the drive-side bearing 20 closer to the tip end of the drive shaft 5 within the side surface of the front housing 2, a discharge port Pout is formed.

The discharge port Pout is an opening portion for discharging low-pressure working fluid from the front housing 2 (housing) to an external circuit.

(Drive-Side Bearing)

The drive-side bearing 20 includes a drive-side inner ring 21, a drive-side outer ring 22, and a plurality of drive-side rolling elements 23.

The drive-side inner ring 21 is formed in an annular shape. The inner peripheral surface of the drive-side inner ring 21 is fixed on the outer peripheral surface of the large-diameter portion 5*a*.

The drive-side outer ring 22 is formed in an annular shape. The outer peripheral surface of the drive-side outer ring 22 is fixed on the inner peripheral surface of the front housing 2.

The drive-side rolling elements 23 are arranged between a recessed portion formed on the outer peripheral surface of the drive-side inner ring 21 and a recessed portion formed on the inner peripheral surface of the drive-side outer ring 22. In the first embodiment, a case where the drive-side rolling elements 23 are formed using cylindrical rollers will be described.

The plurality of drive-side rolling elements 23 are arranged with a gap interposed between each pair of adjacent rolling elements when viewed from the axial direction of the drive shaft 5.

(Fixed Scroll)

The fixed scroll 6 is housed in the rear housing 4.

The fixed scroll 6 includes a fixed-side base portion 6*a*, a fixed-side scroll portion 6*b*, and an inlet 6*c*.

The fixed-side base portion 6*a* is formed in a circular plate shape, and one surface thereof is fixed on a surface of the rear housing 4 facing the front housing 2.

The fixed-side scroll portion 6*b* is formed projecting from the other surface of the fixed-side base portion 6*a* in a spiral shape when viewed from the axial direction of the drive shaft 5.

The inlet 6*c* is a through-hole that is formed near the center of the fixed-side base portion 6*a* and penetrates the fixed-side base portion 6*a*.

The inlet 6*c* is in communication with a suction port Pin that penetrates the surface of the rear housing 4 facing the front housing 2.

The suction port Pin is an opening portion that is formed at a position on the rear housing 4 further apart from the drive shaft 5 than the fixed scroll 6 for introducing high-pressure working fluid from an external circuit into the rear housing 4 (housing).

With the above-described configuration, the fixed scroll 6 is fixed to the side closer to the base end of the drive shaft 5 rather than to the tip end of the drive shaft 5 inside the housing.

(Orbiting Scroll)

The orbiting scroll 7 includes an orbiting-side base portion 7*a*, an orbiting-side scroll portion 7*b*, and a hollow boss portion 7*c*.

The orbiting-side base portion 7*a* is formed in a circular plate shape and arranged between the drive-side bearing 20 and the fixed scroll 6.

One surface of the orbiting-side base portion 7*a* faces the fixed scroll 6.

The orbiting-side scroll portion 7*b* is formed projecting from the one surface of the orbiting-side base portion 7*a* in a spiral shape when viewed from the axial direction of the drive shaft 5.

The orbiting scroll 7 is arranged in such a way that the orbiting-side scroll portion 7*b* meshes with the fixed-side scroll portion 6*b*, and, between the fixed-side scroll portion 6*b* and the orbiting-side scroll portion 7*b*, an expansion chamber 30 in which introduced working fluid is expanded is formed.

Therefore, the drive-side bearing 20 is arranged on the side of the orbiting scroll 7 closer to the tip end of the drive shaft 5 inside the housing.

In addition, a low-pressure chamber 40 into which the working fluid having been expanded in the expansion chamber 30 and having become low-pressure working fluid flows is formed on the outer side of the orbiting-side scroll portion 7*b* when viewed from the axial direction of the drive shaft 5 inside the housing.

The hollow boss portion 7*c* is formed on the other surface of the orbiting-side base portion 7*a* in a cylindrical shape when viewed from the axial direction of the drive shaft 5.

(Driven Crank Mechanism)

The driven crank mechanism 8 couples the large-diameter portion 5*a* and the orbiting scroll 7 and includes an eccentric bush 8*a* and a crank pin 8*b*.

The eccentric bush 8*a* is arranged inside the hollow boss portion 7*c* via an orbiting-side bearing 50.

The orbiting-side bearing 50 includes an orbiting-side inner ring 51, an orbiting-side outer ring 52, and a plurality of orbiting-side rolling elements 53.

The orbiting-side inner ring 51 is formed in an annular shape. The inner peripheral surface of the orbiting-side inner ring 51 is fixed on the outer peripheral surface of the eccentric bush 8*a*.

The orbiting-side outer ring 52 is formed in an annular shape. The outer peripheral surface of the orbiting-side outer ring 52 is fixed on the inner peripheral surface of the hollow boss portion 7*c*.

The each orbiting-side rolling elements 53 are arranged between a recessed portion formed on the outer peripheral surface of the orbiting-side inner ring 51 and a recessed portion formed on the inner peripheral surface of the orbiting-side outer ring 52. In the first embodiment, a case where the orbiting-side rolling elements 53 are formed using cylindrical rollers will be described.

The plurality of orbiting-side rolling elements 53 are arranged with a gap interposed between each pair of adjacent rolling elements when viewed from the axial direction of the drive shaft 5.

The crank pin 8*b* is arranged in parallel with the drive shaft 5.

The central axis of the crank pin 8*b* is offset from the rotation center of the drive shaft 5.

The crank pin 8*b* is inserted into an insertion hole (not illustrated) formed in the eccentric bush 8*a*. The insertion hole is formed at a position offset from the center of the eccentric bush 8*a*.

The eccentric bush 8*a* is configured to be swingable about the axis of the crank pin 8*b*. Because of this configuration, in the driven crank mechanism 8, an orbiting motion of the crank pin 8*b* directly serves as an orbiting motion of the eccentric bush 8*a*, and, on the contrary, an orbiting motion of the eccentric bush 8*a* directly serves as an orbiting motion of the crank pin 8*b*.

Therefore, the driven crank mechanism 8 causes a rotational motion of the drive shaft 5 to be converted to an orbiting motion of the orbiting scroll 7 or an orbiting motion of the orbiting scroll 7 to be converted to a rotational motion of the drive shaft 5.

Note that, in order to prevent vibration or the like from occurring by balancing the eccentric bush 8*a* and the orbiting scroll 7, a counter weight 8*c* (balance weight) is fixed to the eccentric bush 8*a*.

(Sealing Member)

The sealing member 9 is formed including a mechanical seal 9*a*, an O-ring 9*b*, and a seal holder 9*c* and prevents oil present between the drive shaft 5 and the front housing 2 from leaking to the outside.

The mechanical seal 9*a* is formed in an annular shape surrounding a portion of the outer peripheral surface of the drive shaft 5, using, for example, a metallic material. The mechanical seal 9*a* is located apart from the outer peripheral surface of the drive shaft 5 and, in conjunction therewith, is in contact with the inner surface of the front housing 2.

The O-ring 9*b* is formed in an annular shape that comes into contact with and surrounds a portion of the outer peripheral surface of the drive shaft 5, using, for example, a resin material. The O-ring 9*b* is arranged at a position located closer to the drive-side bearing 20 than the mechanical seal 9*a*.

The seal holder 9*c* is formed in a cylindrical shape and holds the mechanical seal 9*a* and the O-ring 9*b* on the inner peripheral surface thereof.

With the above-described configuration, the sealing member 9 is arranged on the side of the drive-side bearing 20 closer to the tip end of the drive shaft 5 inside the front housing 2 (housing) and surrounds a portion of the outer peripheral surface of the drive shaft 5.

Inside the front housing 2 (housing), a space in which the sealing member 9 is arranged forms a tip end-side low-pressure space 60 into which low-pressure working fluid flows from the low-pressure chamber 40.

In the tip end-side low-pressure space 60, a portion of the mechanical seal 9*a* is exposed.

Therefore, gaps formed between adjacent drive-side rolling elements 23 communicate the tip end-side low-pressure space 60 with the low-pressure chamber 40.

Note that the tip end-side low-pressure space 60 includes a passage portion connecting to the discharge port Pout.

(Rotation Preventing Mechanism)

The rotation preventing mechanism 10 is arranged between the other surface of the orbiting-side base portion 7*a* and the center plate 3 and prevents the orbiting scroll 7 from rotating.

The rotation preventing mechanism 10 includes a ball coupling having a plurality of balls 10*a*. Note that, in FIG. 2, only one ball 10*a* among the plurality of balls 10*a* is illustrated.

The plurality of balls 10*a* are arranged in a radial structure with a gap interposed between each pair of adjacent balls 10*a* when viewed from the axial direction of the drive shaft 5.

Therefore, gaps formed between adjacent balls 10*a* communicate the tip end-side low-pressure space 60 with the low-pressure chamber 40.

(Partition Wall)

The partition wall W is disposed at a position that is located between the tip end-side low-pressure space 60 and the low pressure chamber 40 when viewed from a radial direction of the drive shaft 5 and, in conjunction therewith, located closer to the discharge port Pout than the drive shaft 5 when viewed from the axial direction of the drive shaft 5 and partitions the tip end-side low-pressure space 60 and the low pressure chamber 40 from each other.

The partition wall W is arranged on the outer side of the drive-side bearing 20 in radial directions of the drive shaft 5.

(Communication Space)

Figure 3:
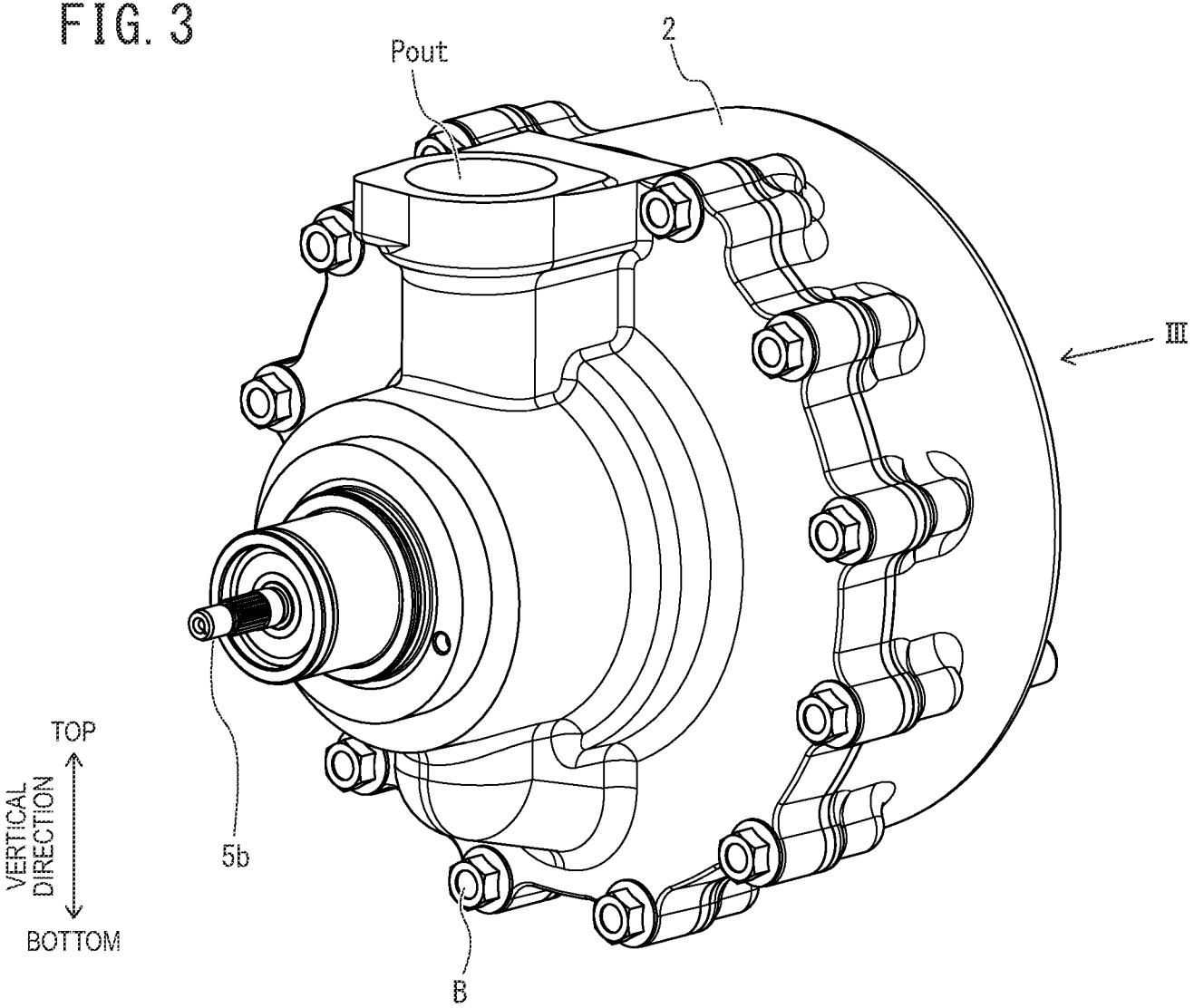
FIG. 3 is a diagram illustrative of a state in which the scroll type expander is viewed from the front housing.
Figure 4:
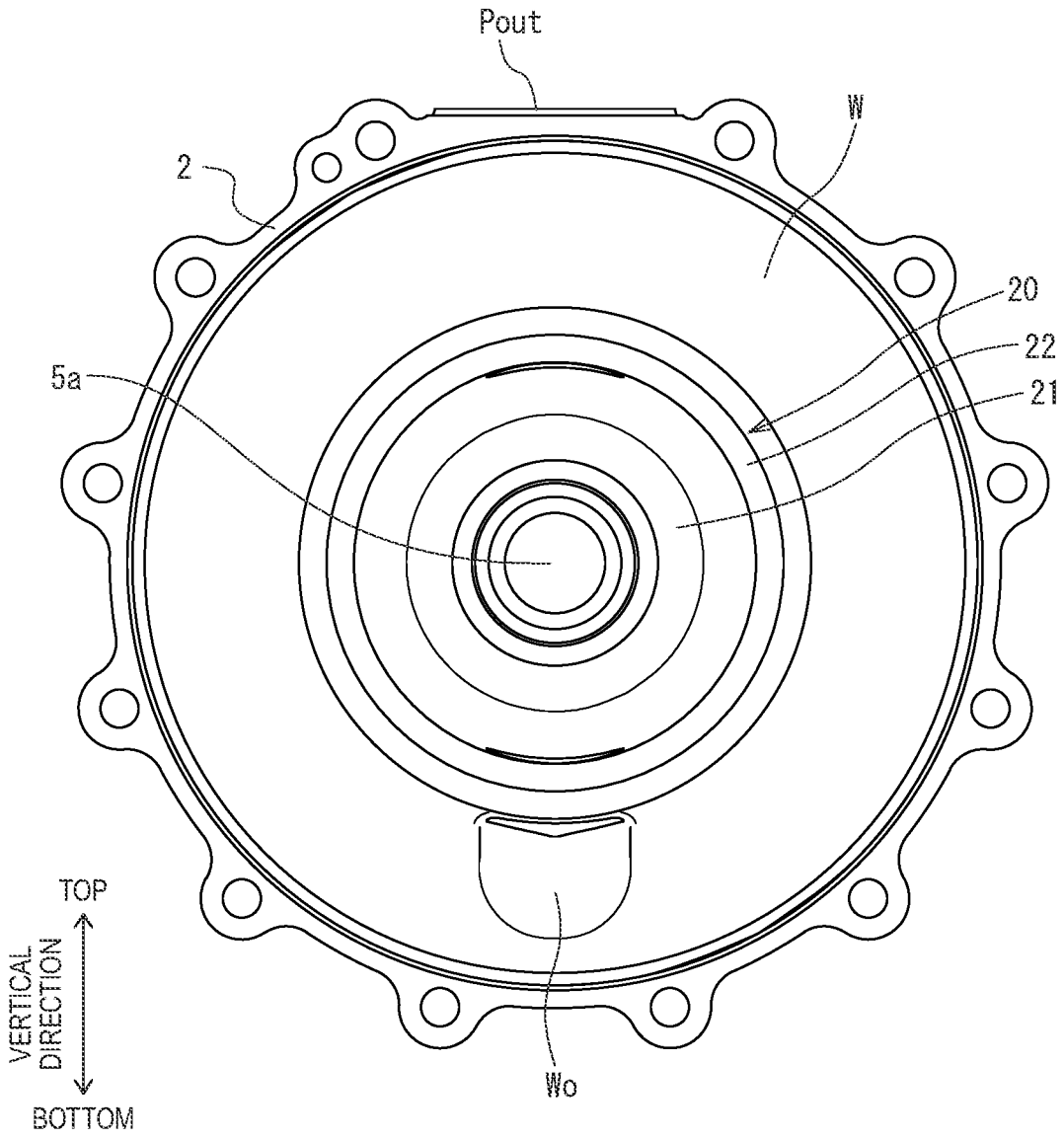
FIG. 4 is a diagram viewed from the arrow III in FIG. 3.

As illustrated in FIGS. 3 and 4, an opening portion Wo is disposed at a position, within the partition wall W, that is opposed to the discharge port Pout with the center of the drive shaft 5 interposed therebetween when viewed from the axial direction of the drive shaft 5. Note that, in FIG. 4, illustration of the drive-side rolling elements 23 is omitted.

The opening portion Wo formed in the partition wall W forms a communication space 70 that communicate the tip end-side low-pressure space 60 with the low-pressure chamber 40.

The communication space 70 is arranged on the outer side of the drive-side bearing 20 in radial directions of the drive shaft 5.

(Operation and Actions)

Using FIG. 5 while referring to FIGS. 1 to 4, an example of operation that the scroll type expander 1 of the first embodiment performs and action thereof will be described.

When the scroll type expander 1 is used, high-temperature (for example, 250° C.) and high-pressure working fluid that has been introduced into the expansion chamber 30 by way of the suction port Pin and the inlet 6*c* expands inside the expansion chamber 30. This operation causes the orbiting scroll 7 to perform an orbiting motion with respect to the fixed scroll 6.

When the orbiting scroll 7 performs an orbiting motion with respect to the fixed scroll 6, the expansion chamber 30 moves from a central portion to a peripheral portion while increasing capacity thereof, associated with the orbiting motion of the orbiting scroll 7, as a result of which the working fluid expands and the pressure of the working fluid becomes low and, in conjunction therewith, the temperature of the working fluid decreases to a low level (for example, 150° C.)

The working fluid after expansion is discharged to the low-pressure chamber 40 and, further, passing gaps formed between adjacent balls 10*a*, moves to a space formed between the orbiting scroll 7, the drive-side bearing 20, and the partition wall W.

In the configuration of the first embodiment, the partition wall W, which is disposed at a position located closer to the discharge port Pout than the drive shaft 5 when viewed from the axial direction of the drive shaft 5, partitions the tip end-side low-pressure space 60 and the low-pressure chamber 40 from each other. In addition to the above, the communication space 70, which is disposed at a position, within the partition wall W, that is opposed to the discharge port Pout with the center of the drive shaft 5 interposed therebetween when viewed from the axial direction of the drive shaft 5, communicates the tip end-side low-pressure space 60 with the low pressure chamber 40. Further, the gaps formed between adjacent drive-side rolling elements 23 communicate the tip end-side low-pressure space 60 with the low-pressure chamber 40.

Because of this configuration, the low-pressure working fluid that has moved to the space formed between the orbiting scroll 7, the drive-side bearing 20, and the partition wall W is prevented from moving from the low-pressure chamber 40 to the tip end-side low-pressure space 60 by the partition wall W.

Figure 5:
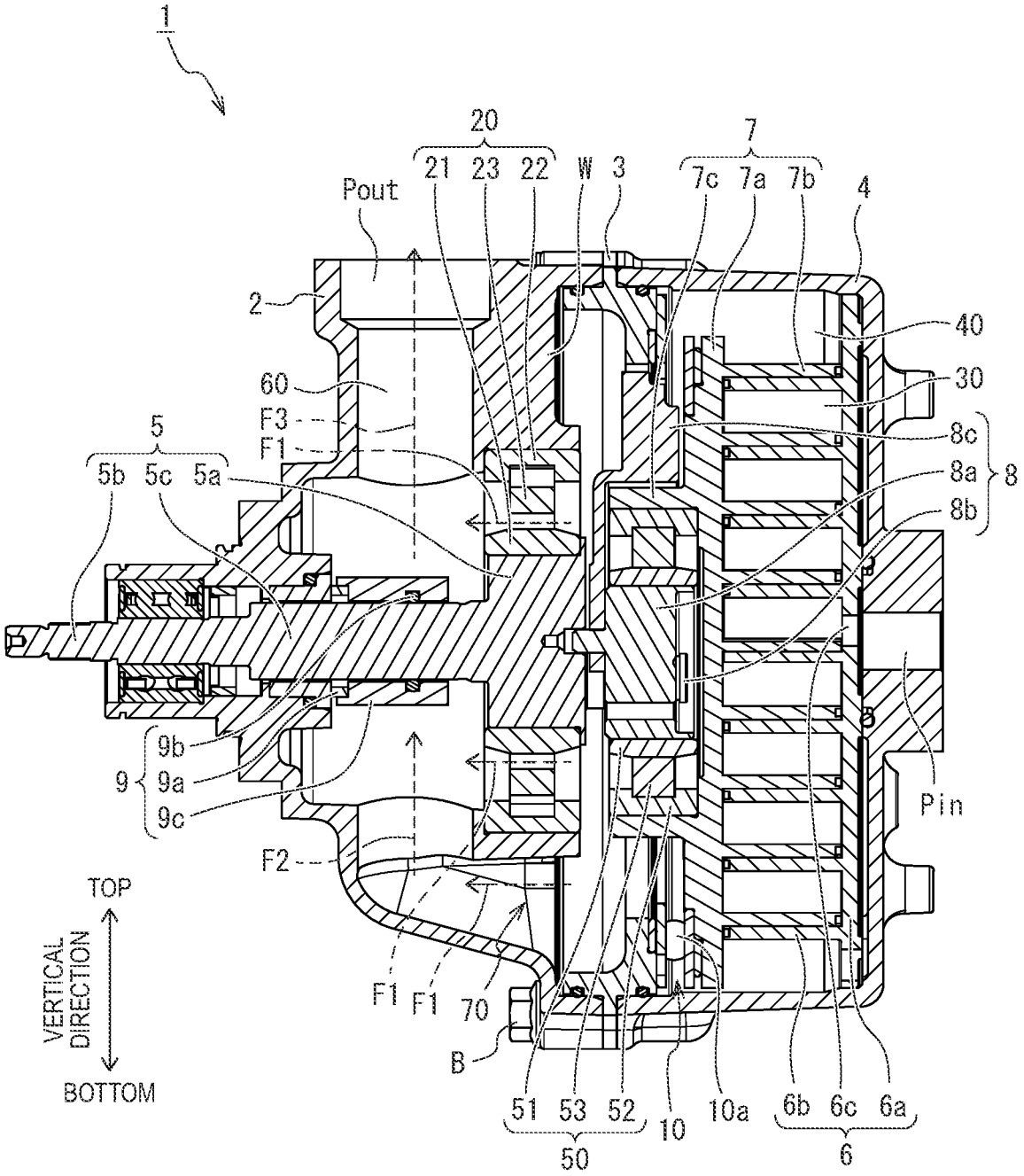
FIG. 5 is a diagram illustrative of operation that the scroll type expander of the first embodiment performs.

Thus, the low-pressure working fluid in the space formed between the orbiting scroll 7, the drive-side bearing 20, and the partition wall W passes the gaps formed between adjacent drive-side rolling elements 23 and the communication space 70, as illustrated by a dashed-line arrow F1 in FIG. 5. The low-pressure working fluid further moves to the tip end-side low-pressure space 60.

The low-pressure working fluid that has moved to the tip end-side low-pressure space 60 actively passes the vicinity of the drive shaft 5 and the sealing member 9 and moves to the discharge port Pout, as illustrated by a dashed-line arrow F2 in FIG. 5. Subsequently, the low-pressure working fluid is discharged to an external circuit from the discharge port Pout, as illustrated by a dashed-line arrow F3 in FIG. 5. In association with the movement of the working fluid in the tip end-side low-pressure space 60, the oil for lubrication enclosed inside the housing is supplied to the sealing member 9.

It should be noted that the foregoing first embodiment is one example of the present invention, the present invention is not limited to the foregoing first embodiment, and, even when the present invention may be carried out in modes other than the embodiment, depending on designs, various changes may be made to the present invention within a scope not departing from the technical idea of the present invention.

Advantageous Effects of First Embodiment

The scroll type expander 1 of the first embodiment enables advantageous effects that will be described below to be attained.

(1) The scroll type expander 1 includes the drive-side bearing 20 that supports the drive shaft 5 in a rotatable structure with respect to the housing via the plurality of drive-side rolling elements 23. In addition to the above, the housing includes the suction port Pin that is formed at a position further apart from the drive shaft 5 than the fixed scroll 6 and the discharge port Pout that is formed on the side of the drive-side bearing 20 closer to the tip end of the drive shaft 5. Further, the housing includes the low-pressure chamber 40 that is formed on the outer side of the orbiting-side scroll portion 7*b* when viewed from the axial direction of the drive shaft 5 and the tip end-side low-pressure space 60 that is a space in which the sealing member 9 is arranged. The partition wall W that partitions the tip end-side low-pressure space 60 and the low pressure chamber 40 from each other is disposed at a position that is located between the tip end-side low-pressure space 60 and the low pressure chamber 40 when viewed from a radial direction of the drive shaft 5 and located closer to the discharge port Pout than the drive shaft 5 when viewed from the axial direction of the drive shaft 5. Further, the communication space 70 that communicates the tip end-side low-pressure space 60 with the low pressure chamber 40 is disposed at a position that is located between the tip end-side low-pressure space 60 and the low pressure chamber 40 when viewed from a radial direction of the drive shaft 5 and is opposed to the discharge port Pout with the center of the drive shaft 5 interposed therebetween when viewed from the axial direction of the drive shaft 5.

Thus, high-pressure working fluid that is introduced into the housing expands in the expansion chamber 30, becomes low-pressure working fluid the temperature of which has decreased, and moves to the low-pressure chamber 40. Further, the low-pressure working fluid that has been prevented from moving from the low-pressure chamber 40 to the tip end-side low-pressure space 60 by the partition wall W, passing the communication space 70 and interspaces between adjacent drive-side rolling elements 23, moves from the low-pressure chamber 40 to the tip end-side low-pressure space 60.

In addition to the above, it becomes possible to move the low-pressure working fluid, which has been prevented from moving from the low-pressure chamber 40 to the tip end-side low-pressure space 60 by the partition wall W, to a position apart from the discharge port Pout.

Because of this capability, it becomes possible to increase the flow rate of the low-pressure working fluid, the temperature of which has decreased from a state when the working fluid was introduced into the housing, that passes the vicinity of the drive shaft 5 and the sealing member 9 and to thereby actively cool the sealing member 9.

In addition to the above, it becomes possible to increase working fluid that moves from the communication space 70, passes the vicinity of the drive shaft 5 and the sealing member 9, and is discharged from the discharge port Pout and to thereby efficiently increase the flow rate of low-pressure working fluid that passes the vicinity of the drive shaft 5 and the sealing member 9.

As a result, it becomes possible to provide the scroll type expander 1 that is capable of suppressing heating of the sealing member 9 and preventing sealing performance of the sealing member 9 from deteriorating.

Since it becomes possible to suppress heating of the sealing member 9, it becomes possible to produce the scroll type expander 1 without applying an expensive sealing member 9 the sealing performance of which is maintained even in a high-temperature environment. This capability enables the production cost of the scroll type expander 1 to be prevented from increasing.

Further, compared with a configuration in which, for example, the partition wall W is disposed at a position located farther from the discharge port Pout than the drive shaft 5 and the communication space 70 is closer to the discharge port Pout than the drive shaft 5 when viewed from the axial direction of the drive shaft 5, it becomes possible to efficiently increase the flow rate of working fluid that moves from a position further apart from the discharge port Pout than the drive shaft 5 within the tip end-side low-pressure space 60, passes the vicinity of the drive shaft 5 and the sealing member 9, and reaches the discharge port Pout.

(2) The partition wall W is arranged on the outer side of the drive-side bearing 20 in radial directions of the drive shaft 5.

As a result, it becomes possible to increase the flow rate of the low-pressure working fluid that is prevented from moving from the low-pressure chamber 40 to the tip end-side low-pressure space 60 by the partition wall W and to efficiently increase the flow rate of the low-pressure working fluid passing the vicinity of the drive shaft 5 and the sealing member 9.

(3) The communication space 70 is arranged on the outer side of the drive-side bearing 20 in radial directions of the drive shaft 5.

Thus, it becomes possible to efficiently move the low-pressure working fluid, which is prevented from moving from the low-pressure chamber 40 to the tip end-side low-pressure space 60 by the partition wall W, to a position apart from the discharge port Pout.

As a result, it becomes possible to efficiently increase the flow rate of the low-pressure working fluid passing the vicinity of the drive shaft 5 and the sealing member 9.

(4) The rotation preventing mechanism 10 for preventing the orbiting scroll 7 from rotating includes a plurality of balls 10*a* arranged in a radial structure with a gap interposed between each pair of adjacent balls 10*a* when viewed from the axial direction of the drive shaft 5, and the gaps formed between adjacent balls 10*a* communicate the tip end-side low-pressure space 60 with the low pressure chamber 40.

Thus, it becomes possible to make the low-pressure working fluid that has moved to the low-pressure chamber 40 move from the low pressure chamber 40 to the tip end-side low-pressure space 60, passing interspaces between adjacent balls 10*a*.

As a result, it becomes possible to increase the flow rate of the low-pressure working fluid, the temperature of which has decreased from a state when the working fluid was introduced into the housing, to the tip end-side low-pressure space 60.

REFERENCE SIGNS LIST

1 Scroll type expander
2 Front housing
3 Center plate
4 Rear housing
5 Drive shaft
5*a* Large-diameter portion
5*b* Small-diameter portion
5*c* Intermediate portion
6 Fixed scroll
6*a* Fixed-side base portion
6*b* Fixed-side scroll portion
6*c* Inlet
7 Orbiting scroll
7*a* Orbiting-side base portion
7*b* Orbiting-side scroll portion
7*c* Hollow boss portion
8 Driven crank mechanism
8*a* Eccentric bush
8*b* Crank pin
8*c* Counter weight
9 Sealing member
9*a* Mechanical seal
9*b* O-ring
9*c* Seal holder
10 Rotation preventing mechanism
10*a* Ball
20 Drive-side bearing
21 Drive-side inner ring
22 Drive-side outer ring
23 Drive-side rolling element
30 Expansion chamber
40 Low pressure chamber
50 Orbiting-side bearing
51 Orbiting-side inner ring
52 Orbiting-side outer ring
53 Orbiting-side rolling element
60 Tip end-side low-pressure space
70 Communication space
W Partition wall
Wo Opening portion
B Through bolt
Pout Discharge port
Pin Suction port
F1 Flow of working fluid moving from the low pressure chamber 40 to the tip end-side low-pressure space 60
F2 Flow of working fluid moving from the tip end-side low-pressure space 60 to the discharge port Pout
F3 Flow of working fluid discharged from the discharge port Pout to an external circuit

The invention claimed is:

1. A scroll expander used in a Rankine cycle in which a working fluid circulates, comprising:

a housing formed of a front housing and a rear housing;

a drive shaft a base end of which is housed in the housing and a tip end of which projects out of the housing;

a fixed scroll fixed to a side closer to the base end of the drive shaft rather than to the tip end of the drive shaft inside the housing;

an orbiting scroll arranged on a side of the fixed scroll closer to the tip end of the drive shaft in a rotatable structure inside the housing;

a bearing arranged on a side of the orbiting scroll closer to the tip end of the drive shaft inside the housing and configured to support the drive shaft in a rotatable structure with respect to the housing via a plurality of rolling elements; and a sealing member arranged on a side of the bearing closer to the tip end of the drive shaft inside the housing and configured to surround an outer peripheral surface of the drive shaft, wherein the fixed scroll has a fixed-side scroll portion formed in a spiral shape when viewed from an axial direction of the drive shaft, the orbiting scroll has an orbiting-side scroll portion formed in a spiral shape when viewed from the axial direction of the drive shaft and meshing with the fixed-side scroll portion, the housing includes a suction port formed at a position on an opposite side to the drive shaft with the fixed scroll interposed between the suction port and the drive shaft and configured to introduce high-pressure working fluid from an external circuit, a discharge port formed on a side of the bearing closer to the tip end of the drive shaft and configured to discharge low-pressure working fluid to an external circuit, a low pressure chamber formed on an outer side of the orbiting-side scroll portion when viewed from an axial direction of the drive shaft, and a tip end-side low-pressure space being a space in which the sealing member is arranged, the front housing is provided with a partition wall configured to partition the tip end-side low-pressure space and the low pressure chamber from each other, the partition wall being disposed at a position located between the tip end-side low-pressure space and the low pressure chamber when viewed from a radial direction of the drive shaft and located closer to the discharge port than the drive shaft when viewed from the axial direction of the drive shaft, a communication space configured to communicate the tip end-side low-pressure space with the low pressure chamber is disposed at a position located between the tip end-side low-pressure space and the low pressure chamber when viewed from a radial direction of the drive shaft and opposed to the discharge port with a center of the drive shaft interposed between the position and the discharge port when viewed from the axial direction of the drive shaft; and when the low-pressure working fluid that has moved from the communication space to the tip end-side low-pressure space flows to the discharge port, the low-pressure working fluid actively flows around the sealing member exposed in the tip end-side low-pressure space to actively cool the sealing member.

2. The scroll expander according to claim 1, wherein the partition wall is arranged on an outer side of the bearing in radial directions of the drive shaft.

3. The scroll expander according to claim 2, wherein the communication space is arranged on an outer side of the bearing in radial directions of the drive shaft.

4. The scroll expander according to claim 2 comprising a rotation preventing mechanism configured to prevent the orbiting scroll from rotating, wherein the rotation preventing mechanism includes a ball coupling including a plurality of balls arranged in a radial structure with a gap interposed between each pair of adjacent balls when viewed from the axial direction of the drive shaft, and gaps formed between adjacent balls communicate the tip end-side low-pressure space with the low-pressure chamber.

5. The scroll expander according to claim 1, wherein the communication space is arranged on an outer side of the bearing in radial directions of the drive shaft.

6. The scroll expander according to claim 5 comprising a rotation preventing mechanism configured to prevent the orbiting scroll from rotating, wherein the rotation preventing mechanism includes a ball coupling including a plurality of balls arranged in a radial structure with a gap interposed between each pair of adjacent balls when viewed from the axial direction of the drive shaft, and gaps formed between adjacent balls communicate the tip end-side low-pressure space with the low-pressure chamber.

7. The scroll expander according to claim 1 comprising a rotation preventing mechanism configured to prevent the orbiting scroll from rotating, wherein the rotation preventing mechanism includes a ball coupling including a plurality of balls arranged in a radial structure with a gap interposed between each pair of adjacent balls when viewed from the axial direction of the drive shaft, and gaps formed between adjacent balls communicate the tip end-side low-pressure space with the low-pressure chamber.

* * * * *